US008387705B2

(12) United States Patent
Heironimus

(10) Patent No.: US 8,387,705 B2
(45) Date of Patent: Mar. 5, 2013

(54) SYSTEMS AND METHODS FOR RUNNING CASING INTO WELLS DRILLED WITH DUAL-GRADIENT MUD SYSTEMS

(75) Inventor: Mark Heironimus, Sugar Land, TX (US)

(73) Assignee: BP Corporation North America Inc., Houston, TX (US)

( * ) Notice: Subject to any disclaimer, the term of this patent is extended or adjusted under 35 U.S.C. 154(b) by 82 days.

(21) Appl. No.: 12/835,473

(22) Filed: Jul. 13, 2010

(65) Prior Publication Data

US 2011/0036588 A1 Feb. 17, 2011

Related U.S. Application Data

(60) Provisional application No. 61/233,397, filed on Aug. 12, 2009.

(51) Int. Cl.
*E21B 7/12* (2006.01)

(52) U.S. Cl. ..... 166/358; 166/359; 166/367; 166/369

(58) Field of Classification Search ..... 166/358, 166/359, 367, 369, 372, 95.1, 75.15, 80.01; 175/5–10

See application file for complete search history.

(56) References Cited

U.S. PATENT DOCUMENTS 4,042,014 A 8/1977 Scott
4,099,583 A 7/1978 Maus
4,399,870 A 8/1983 Baugh et al.
4,658,904 A 4/1987 Doremus et al.
5,029,642 A 7/1991 Crawford
5,873,420 A 2/1999 Gearhart
6,003,834 A 12/1999 Read
6,328,107 B1 12/2001 Maus
6,367,566 B1 * 4/2002 Hill ..... 175/57
6,401,824 B1 6/2002 Musselwhite et al.
6,457,528 B1 10/2002 Staudt
6,530,437 B2 3/2003 Maurer et al.
6,536,540 B2 3/2003 de Boer
6,607,042 B2 * 8/2003 Hoyer et al. ..... 175/38
6,619,388 B2 9/2003 Dietz et al.
6,684,957 B2 2/2004 Allamon
6,712,145 B2 3/2004 Allamon
6,745,857 B2 6/2004 Gjedebo
6,802,379 B2 10/2004 Dawson et al.
6,843,331 B2 1/2005 de Boer
6,926,101 B2 8/2005 de Boer
6,953,097 B2 10/2005 Seyffert
6,964,298 B2 * 11/2005 Zupanick ..... 166/50
7,207,395 B2 * 4/2007 Zupanick ..... 175/40

(Continued)

OTHER PUBLICATIONS

PCT Notification of Transmittal of the International Search Report and the Written Opinion of the International Searching Authority, or Declaration for International Application No. PCT/US2010/041837, dated Mar. 4, 2011, 3 pages.

(Continued)

*Primary Examiner* — Thomas Beach
*Assistant Examiner* — Aaron Lembo
(74) *Attorney, Agent, or Firm* — Jayne C. Piana

(57) ABSTRACT

Systems and methods for running and cementing casing into wells drilled with dual-gradient mud systems include running casing through a subsea wellhead connected to a marine riser, the casing having an auto-fill float collar, and connecting a landing string to the last casing run. The landing string includes a surface-controlled valve (SCV) and a surface-controlled ported circulating sub (PCS). The SCV and PCS are manipulated as needed when running casing, washing it down while preventing u-tubing on connections and prior to cementing to displace mixed density mud from the landing string and replace it with heavy-density mud prior to circulating below the mudline thus maintaining the dual gradient effect.

21 Claims, 10 Drawing Sheets

U.S. PATENT DOCUMENTS

| | | | | |
|---|---|---|---|---|
| 7,299,880 | B2 | 11/2007 | Logiudice et al. | |
| 7,789,162 | B2 | 9/2010 | Keller et al. | |
| 2002/0011338 | A1* | 1/2002 | Maurer et al. | 166/372 |
| 2003/0116324 | A1 | 6/2003 | Dawson et al. | |
| 2004/0084214 | A1* | 5/2004 | deBoer | 175/7 |
| 2005/0023038 | A1* | 2/2005 | Seyffert | 175/65 |
| 2006/0196663 | A1 | 9/2006 | Keller | |
| 2007/0007041 | A1* | 1/2007 | Krueger et al. | 175/57 |
| 2007/0027036 | A1 | 2/2007 | Polizzotti et al. | |
| 2008/0053706 | A1* | 3/2008 | Keller | 175/72 |
| 2008/0302570 | A1* | 12/2008 | deBoer | 175/25 |
| 2009/0084604 | A1 | 4/2009 | Polizzotti et al. | |
| 2009/0090558 | A1 | 4/2009 | Polizzotti et al. | |
| 2009/0090559 | A1 | 4/2009 | Polizzotti et al. | |
| 2009/0091053 | A1 | 4/2009 | Polizzotti et al. | |
| 2011/0061872 | A1* | 3/2011 | Mix et al. | 166/363 |

OTHER PUBLICATIONS

PCT Notification of Transmittal of the International Search Report and the Written Opinion of the International Searching Authority, or Declaration for International Application No. PCT/US2010/041837, dated Mar. 4, 2011, 12 pages.

Rasmussen et al., "Evaluation of MPD Methods for Surge-and-Swab Pressures in Floating Drilling Applications", IDAC/SPE 108346, Mar. 28, 2007, pp. 1-11, Society of Petroleum Engineers Inc., United States.

Tenarishydril, "Introducing a New World of Premium Connections", Sep. 2008, pp. 1-6, TenarisHydril, publication city and country unknown.

Perdue, J.M., "Downhole tool minimizes surge", E&P Magazine, Aug. 1, 2002, pp. 1-2, Hart downloaded from the Internet on Jun. 20 2009, at url http://www.epmag.com/archives/print/3191.htm.

* cited by examiner

SYSTEMS AND METHODS FOR RUNNING CASING INTO WELLS DRILLED WITH DUAL-GRADIENT MUD SYSTEMS

CROSS-REFERENCE TO RELATED APPLICATIONS

The present application claims priority under 35 U.S.C. §119(e) to U.S. Provisional Application Ser. No. 61/233,397, filed Aug. 12, 2009, which is incorporated by reference herein in its entirety.

BACKGROUND INFORMATION

1. Technical Field

The present disclosure relates in general to well control and intervention systems and methods. More particularly, the present disclosure relates to systems and methods for running casing in wells drilled with dual—and/or multi-gradient mud systems.

2. Background Art

Drilling operations that encompass various methods of drilling a subsea well with two different fluid densities or mud weights (Dual Gradient Drilling Systems) have been publicized. See for example, U.S. Pat. Nos. 6,536,540; 6,843,331, and 6,926,101. Previous industry projects have developed and are developing drilling methodologies to safely employ the technology. Benefits of a dual gradient drilling system include reduction of the hydrostatic pressure in the well annulus above the bottom or at a previous casing point while simultaneously maintaining a higher equivalent hydrostatic pressure at the bottom of the hole. There are also known so-called "multi-gradient" mud systems, in which beads having density less than a heavy mud are added to a portion of the heavy mud present in a marine riser. Such mud systems are known (using incompressible beads), for example, from U.S. Pat. Nos. 6,530,437 and 6,953,097. Finally, there have been disclosed so-called "variable density" mud systems employing compressible beads, such as described in published U.S. Pat. App. Nos. 20070027036; 20090090559; 20090090558; 20090084604; and 20090091053. The methods and systems described in the present disclosure are applicable to all of these different types of mud systems, and are generally referred to herein simply as "dual gradient mud systems." The patent documents referenced in this paragraph are incorporated herein by reference for their disclosure of multi-gradient and variable gradient mud systems.

Although previous research projects have developed equipment and methodologies to drill wells with dual gradient mud systems, systems and methods to run casing in these wells, with the dual gradient mud systems in place, have not been developed previously. Due to very tight margins between the mud weight needed to control pressures in deep subsea wells and to simultaneously not induce sufficient pressure to cause formation breakdown in the annulus above total depth with resulting fluid losses to the formation between a casing shoe and total depth, what remains needed are systems and methods that allow casing to be run with surge reduction equipment thereby avoiding inducing fluid losses that would jeopardize the well and the primary cement job in particular.

Current practice for running casing in wells drilled with dual gradient muds is reflected in U.S. Pat. No. 6,328,107, which discloses a method for controlling the pressure at the base of a gas-lifted riser during casing installation. Prior to casing installation, drilling fluid is displaced from the riser and the riser is filled with seawater. During casing installation, the riser base pressure is monitored, and the height of seawater in the riser is adjusted to compensate for increases in the riser base pressure. The riser base pressure is thereby maintained substantially equal to the seawater pressure at the base of the drilling riser throughout installation of the casing.

It would be advantageous if systems and methods could be developed that safely allow casing to be run into wells (and cemented) with a dual gradient mud system efficiently and with improvements in well control. It would also be advantageous if the systems and methods would allow management of the dual gradient mud system and maintain the benefit of having a dual gradient mud system in the well. The systems and methods of the present disclosure are directed to these needs.

SUMMARY

In accordance with the present disclosure, apparatus, systems and methods are described which allow casing of subsea wells drilled with dual gradient muds or dual gradient fluids (the term "mud" is used herein as encompassing both drilling muds and drilling fluids) to proceed safely and efficiently, without sacrificing the benefits of the dual gradient mud system already in place in the subsea well from the drilling operation.

A first aspect of the disclosure is a system comprising, in combination:

- a riser conduit for containing a mixed density drilling mud above the mud line, the mixed-density mud formed by mixing a portion of a relatively high-density mud with a portion of a relatively low-density mud, the riser conduit fluidly connecting a floating or semi-submersed platform to a subsea wellhead (via a subsea BOP stack or alternative connection, as noted herein) located substantially at the mud line, the wellhead fluidly connecting the riser conduit and a subsea well accessing a subsea formation of interest;
- a plurality of casing members comprising a first and a last casing member run into the well for casing the subsea well in the presence of the relatively high-density drilling mud in the well; and
- a drill pipe landing string comprising a surface-controlled valve at its distal end, and a ported circulation sub located just above the surface-controlled valve,
- wherein the distal end of the first casing member comprises an auto-fill collar, wherein the distal end of the drill pipe landing string fluidly connects to the last casing member run in the well, and wherein the surface-controlled valve and the ported circulation sub are positioned to substantially maintain the dual gradient mud system in the riser conduit and well.

In certain embodiments, the system comprises a surface control line (such as ¼ inch (0.64 cm) diameter or ⅜ inch (1.9 cm) diameter or similar steel tubing) providing a control connection between the surface-controlled valve (and ported circulating sub) and a controller on the floating platform. In certain embodiments this control may be performed by a "wired" drillpipe, such as the wired drillpipe available from National Oilwell Varco, Inc., Houston, Tex., under the trade designation "INTELLIPIPE." In other embodiments the system comprises one or more density control lines, sometimes referred to herein as "boost lines", fluidly connecting the riser internal space just above the mud line with a source of a relatively low-density mud, wherein the density of the relatively low-density mud is less than the density of the relatively high-density mud, as further explained herein. The term "mixed-density" mud is used to refer to one or more blends maintained in the drilling riser by combining a portion of a high-density mud being pumped from below the mudline to the drilling riser with a portion of a relatively low-density mud being pumped via the "boost line".

Monitoring pressure in the riser substantially near the mud line may be accomplished by one or more pressure indicators located on and/or in the riser, substantially near the mud line. To prevent an annulus overpressure situation in the largest diameter well casing, especially but not limited to during cementing operations, one or more annular pressure buildup prevention means may be included in certain embodiments, such means including annular pressure burst discs. (Such sub-systems are known, for example as disclosed in U.S. Pat. No. 6,457,528, assigned to Hunting Oil Products, Houston, Tex., the disclosure of which is incorporated herein by reference.) This allows certain systems of the disclosure to include cement between a casing run in hole and the well bore.

The auto-fill collar and riser, surface-controlled valve and ported circulation sub, and the drill pipe landing string, while known individually in the art, have not before been combined or used in combination as described herein, and in combination provide the advantage of allowing casing to be run into subsea wells drilled with dual gradient mud systems, while advantageously maintaining the dual gradient mud systems for well control.

Another aspect of the disclosure is a method of running casing into well drilled with a dual-gradient mud system formed at least in part from a relatively low-density mud and a relatively high-density mud, the method comprising:

- running one or more casing members through a subsea wellhead connected to a marine riser, the first casing member equipped with an auto-fill float collar on its distal end, the marine riser filled with a mixed-density mud, the mixed-density mud formed by mixing a portion of the relatively high-density mud with a portion of the relatively low-density mud;
- connecting a drill pipe landing string (DPLS) to the last casing run and running the DPLS toward the wellhead located near the mud line, the DPLS including a surface-controlled valve (SCV) and a surface-controlled ported circulating sub (PCS);
- closing the SCV and circulating the mixed-density mud in the DPLS into the riser by pumping the relatively high-density mud via the PCS prior to circulating down the hole;
- closing the circulating ports of the PCS and opening the SCV, and commencing circulating the casing down by pumping the relatively high-density mud as the DPLS is lowered into the well;
- stopping pumping, closing the SCV, leaving the PCS closed, thereby closing off the DPLS so u-tubing cannot occur; and
- connecting the next stand of DPLS, opening the SCV, and continue running casing and DPLS until landing the casing on the subsea wellhead.

By running casing through a subsea wellhead with the casing equipped with an auto-fill float collar on its distal end, the collar will naturally maintain a balanced mud column in and out of the casing while running in. Also, by closing the SCV and circulating the mixed-density mud in the DPLS into the riser via the PCS prior to circulating down the hole, the dual-gradient effect will be maintained, the well will not be underbalanced by pumping the relatively low-density mud to the bottom of the well and hydrostatic pressure will balance, thus controlling the well. Additional method embodiments include, if necessary, closing the SCV and testing the DPLS prior to well control operations; closing the SCV and rigging up cementing equipment to the DPLS, re-opening the SCV, with the PCS remaining closed, and commencing cementing operations while maintaining the dual-gradient effect; and after cementing operations, circulating the relatively low-density mud from the well using the SCV and PCS, or optionally leaving the relatively low-density mud in place and adjusting the density of the relatively high-density mud using the relatively low-density mud for casing the next hole section.

The systems and methods described herein may provide other benefits, and the systems and methods for maintaining the dual-gradient effect are not limited to the systems and methods noted; other systems and methods may be employed.

These and other features of the systems and methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics can be obtained is explained in the following description and attached drawings in which.

Figure 1:
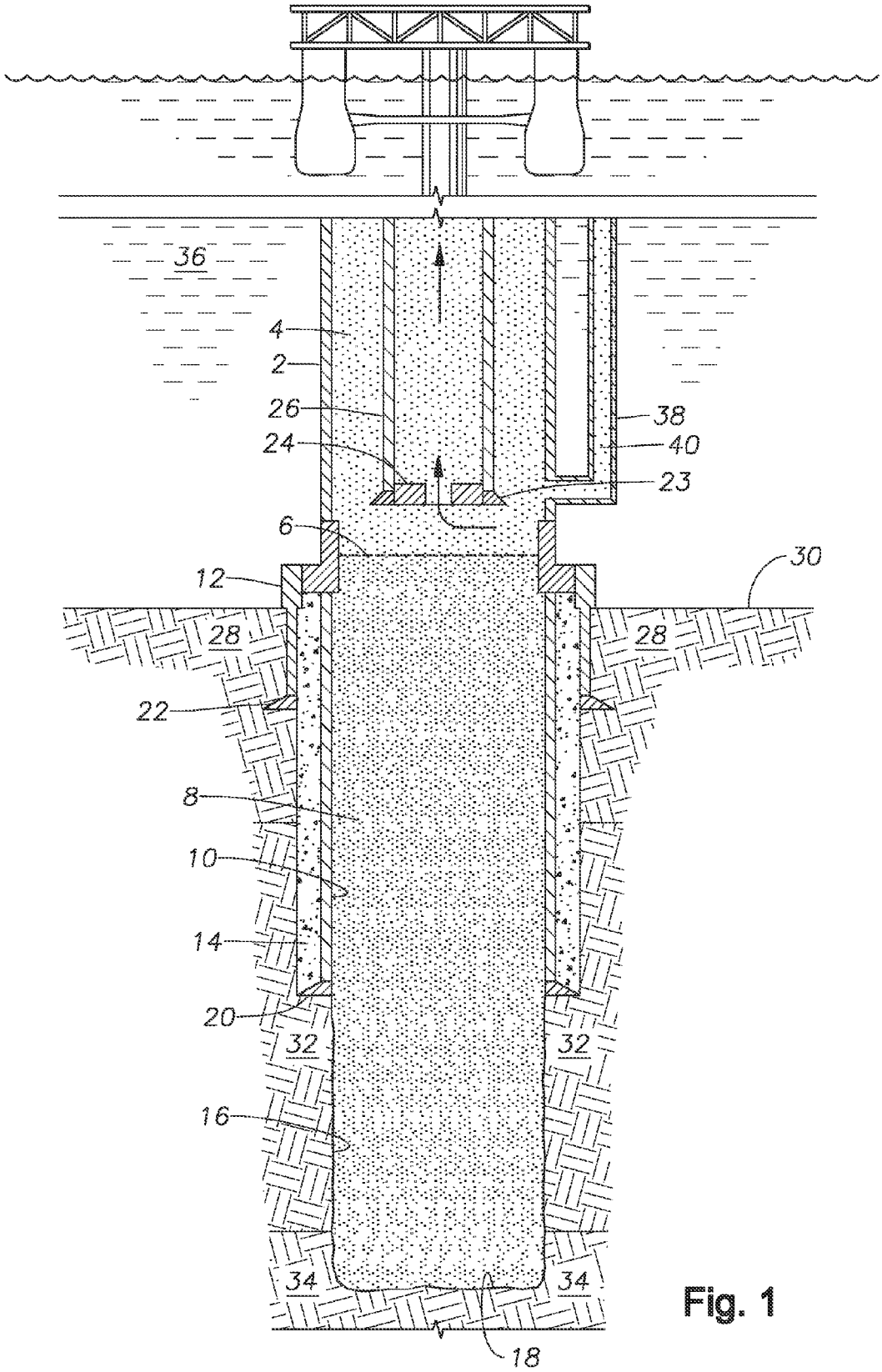
FIGS. 1-6 and 8-9 are schematic cross-section views of one system embodiment within the present disclosure.

It is to be noted, however, that the appended drawings are not to scale and illustrate only typical embodiments of this disclosure, and are therefore not to be considered limiting of its scope, for the systems and methods of the disclosure may admit to other equally effective embodiments. Identical reference numerals are used throughout the several views for like or similar elements.

DETAILED DESCRIPTION

In the following description, numerous details are set forth to provide an understanding of the disclosed methods and apparatus. However, it will be understood by those skilled in the art that the methods and apparatus may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romantic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

As used herein the phrases "relatively low-density mud" and "relatively high-density mud" simply mean that the former has a lower density than the latter when used in the well. In addition, the phrase "mixed-density mud" simply means a mud having a density that is less than the relatively high-density mud, and more than the relatively low-density mud. The relatively high-density mud should have density that is at least 5 percent more than the relatively-low density mud. In certain embodiments, the relatively high-density mud may be 6, or 7, or 8, or 9, or 10, or 15, or 20, or 25, or 30, or more percent higher (heavier) than the relatively low-density mud. The relatively low-density mud may reduce the density of the relatively high-density mud to which it is added by 1 percent, or in some embodiments by 2, or 3, or 4, or 5, or 10, or 15, or 20, or 25, or 30 percent or more. The relatively high-density and relatively low-density muds may either be water-based or synthetic oil-based muds. As an example, the density of the relatively high-density mud may be about 14.5 pounds per gallon (ppg), the density of the relatively low-density mud may be about 9 ppg, and the mixed-density mud resulting from combining these two muds may range from about 14.0 ppg to about 9.5 ppg, or about 12.8 ppg. In another example, the relatively high-density mud may have a density of about 13.5 ppg, the relatively low-density mud may have a density of about 9 ppg, and the mixed-density mud resulting from combining these two muds may have density of about 11.5 ppg.

As noted above, systems and methods have been developed which allow casing of subsea wells drilled with dual gradient muds to proceed safely and efficiently, without sacrificing the benefits of the dual gradient mud system already in place in the subsea well from the drilling operation. Systems and methods of this disclosure reduce or overcome many of the faults of previously known systems and methods.

The primary features of the systems and methods of the present disclosure will now be described with reference to FIGS. 1-9, after which some of the operational details will be explained in reference to the logic diagram in FIG. 10. The same reference numerals are used throughout to denote the same items in the figures. In accordance with the present disclosure, a dual gradient mud system is illustrated in place as illustrated in FIG. 1, the dual gradient and system having been used in drilling the well, as is known. A subsea riser 2 extends from a surface of semi-submerged vessel through seawater 36 and serves to generally contain a mixed-density mud 4, represented by light stippling in the figures. A casing 10 generally contains a relatively high-density mud 8 represented in the figures by heavy stippling. An interface 6 exists between mixed density mud 4 and relatively high-density mud 8. Interface 6 may or may not be as clearly defined as depicted in the various drawing figures, depending on the compositions of the muds. The relatively high-density mud 8 is present at this stage all the way down to the bottom, 18, of open hold region 16 of the well bore. Riser 2 connects to a wellhead 12 in known fashion via the subsea BOP (not illustrated for clarity), while solidified cement 14 is illustrated between wellhead 12 and casing shoe 22, between casing 10 and geologic formation 32. An uncased or open-hole portion of the well bore 16 has yet to be cased, and extends down to another geologic formation 34. Lower casing shoe 20 and upper casing shoe 22 are illustrated. Geologic formations 28, 32, and 34 are generic and typical subsea geologic formations.

In accordance with the present disclosure, casing 26 is run in hole using an auto-fill casing float collar 24 on its distal end. Casing and auto-fill casing float collars are known separately in the art, but have not been suggested for practicing the methods and systems of the present disclosure. Suitable examples and details of each component will be referenced herein below. As casing 26 and auto-fill collar 24 are run in the hole, mixed-density mud 8 is allowed to fill casing 26 through auto-fill collar 24, as indicated in FIG. 1 by the arrows. Completing FIG. 1 is a booster line 38 for routing relatively low-density mud 40, as explained presently. A subsea BOP is typically installed near the mudline and connects riser 2 to wellhead 12. This BOP has been excluded from the drawings for simplicity.

Figure 2:
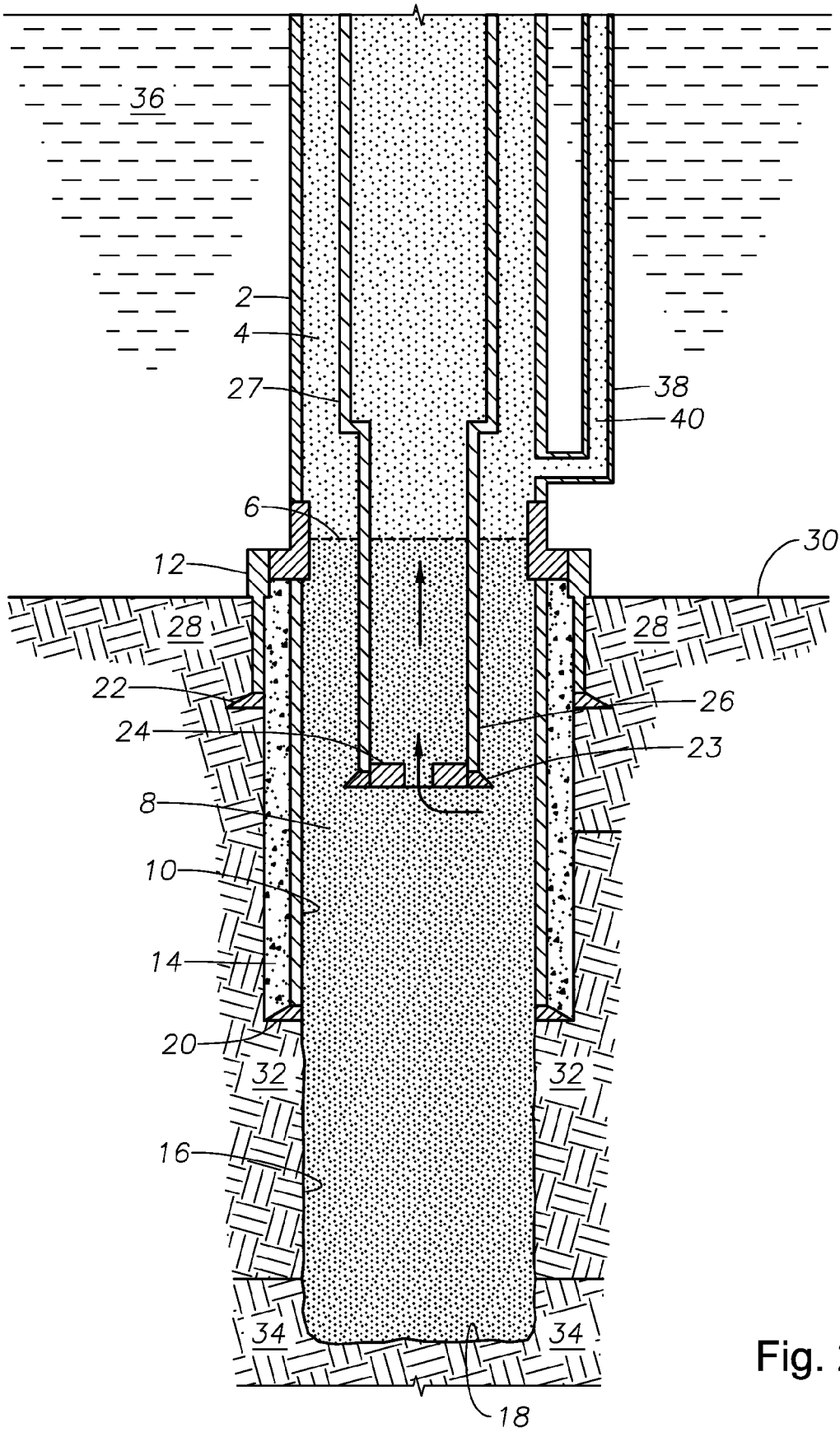
Figure 3:
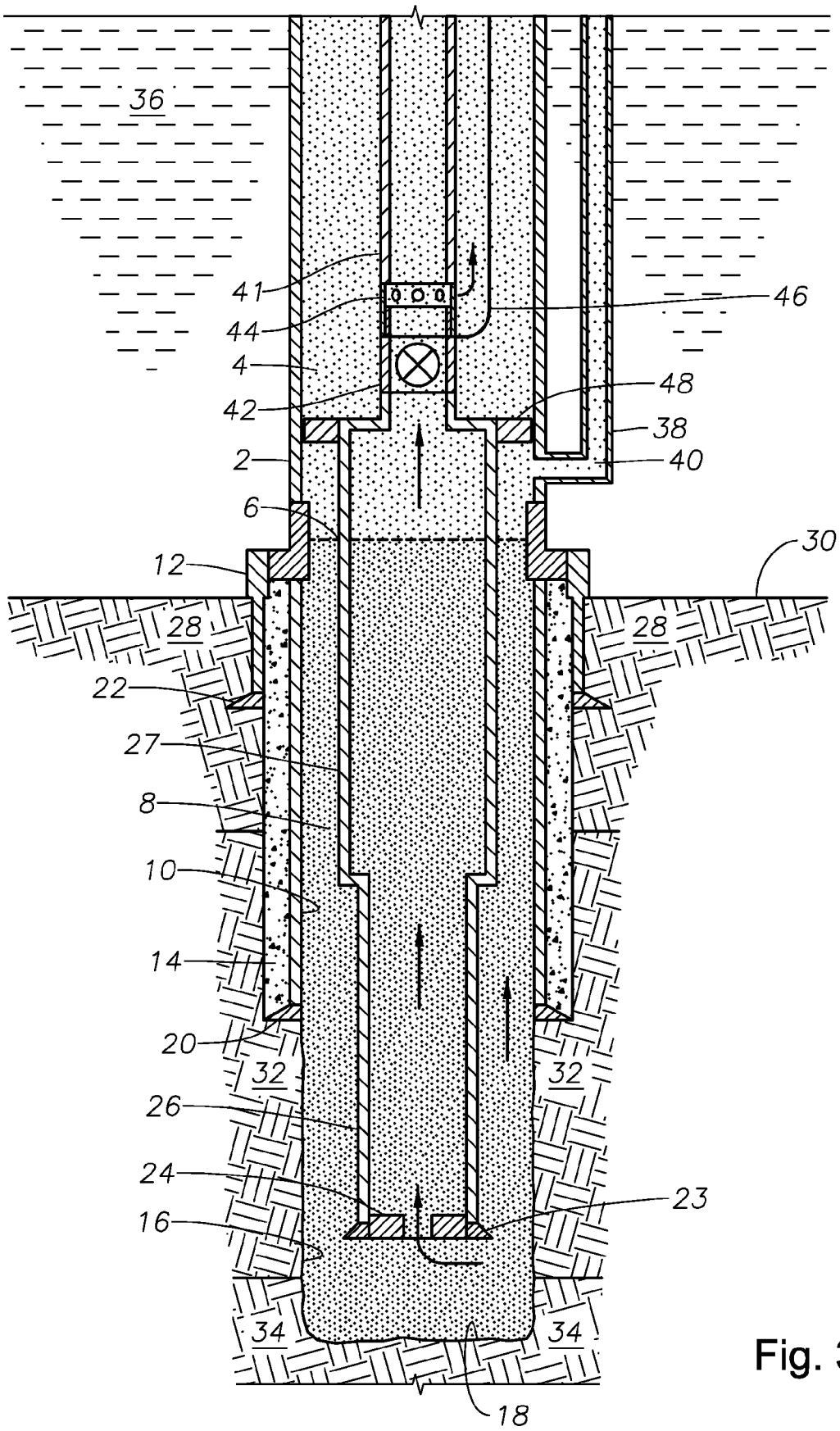

As depicted in FIG. 2, casing 26 of required outside diameter (OD) and auto-fill collar continue to be run into the well as in conventional operations. Once casing 26 descends far enough and enters the region of relatively high-density mud 8, the introduction of casing 26 and auto-fill collar causes relatively high-density mud 8 in the well to be displaced upward. Constant pressure at the interface 6 is maintained by introducing a relatively low-density mud at or near the mud line 30 to maintain the dual gradient effect.

Referring now to FIGS. 3, 4, 5, and 6, in sequence, after running all casing 26, the last casing 27 is run on into the well to the subsea wellhead located near the mudline, with a drill pipe landing string 41 comprising a surface-controlled valve 42 and a surface-controlled ported circulation sub 44 mounted to the drill pipe distal end. Surface-controlled valve 42 and surface-controlled ported circulating sub 44 will control the movement of different fluid densities into the well as described herein. Both are surface controlled through one or more control lines, one being depicted at 46. The dual gradient mud system is maintained during this running in hole of casings 26 and 27 (tapered casing string is illustrated, but this is not required), with the mixed-density and relatively high-density muds flowing or moving as illustrated by the arrows, with both the surface-controlled valve 42 and surface-controlled ported circulating sub 44 open. Surface control line or lines may be hydraulic or electronic. A casing hanger 48 is illustrated screwed onto the top of casing 27.

Figure 4:
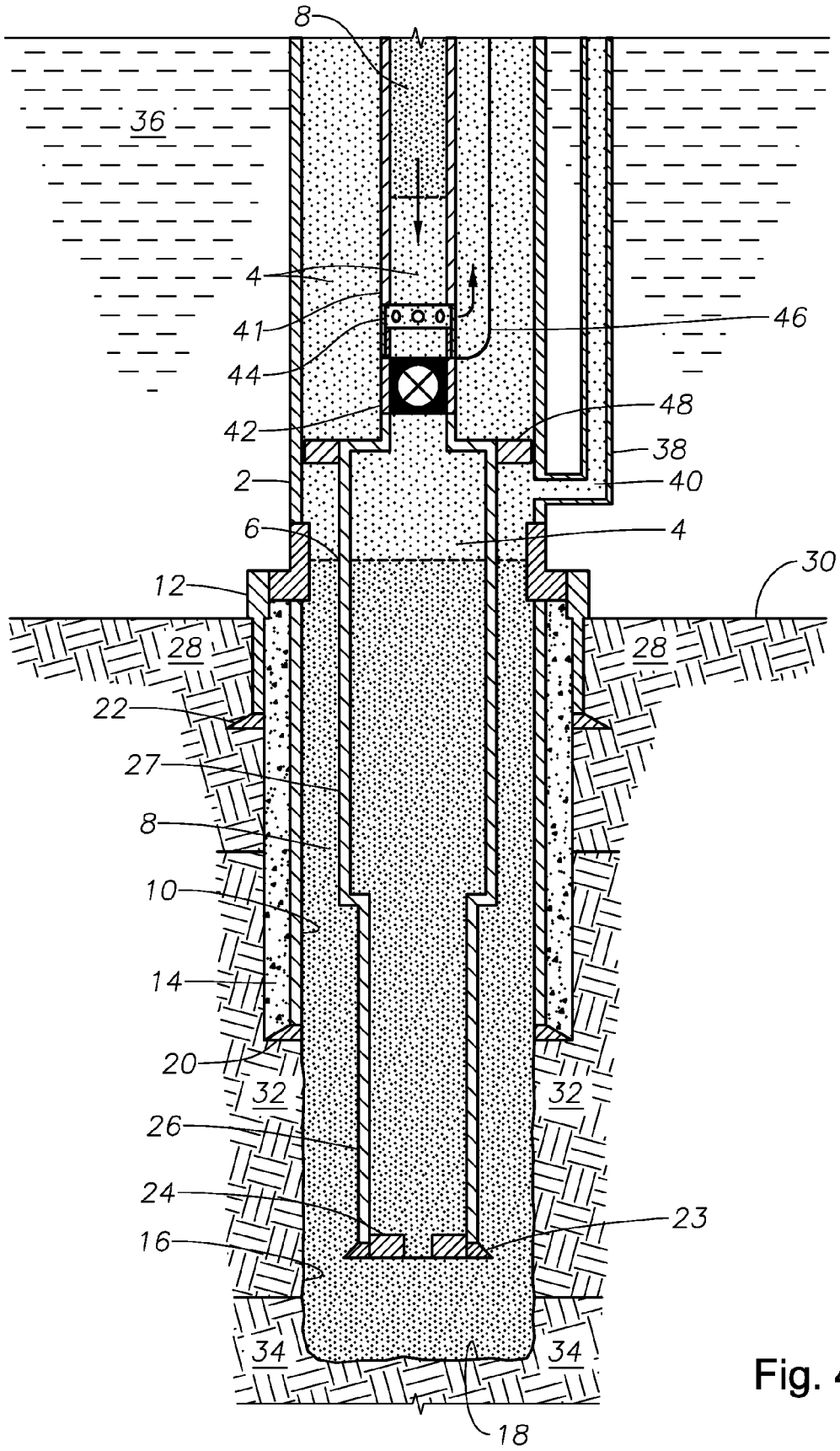

FIG. 4 illustrates that near the bottom of the well the casing may need to be circulated. Without this technique, circulation would undesirably send a portion of the mixed-density mud 4 present in the top of the well in riser 2 and drill pipe landing string 41 down casing sections 27 and 26, thus threatening the hydrostatic balance of the well. The new technique described here will allow the mixed-density mud 4 in drill pipe landing string 41 to be circulated safely into riser 2 via ported circulating sub 44 (as indicated by the arrow in FIG. 4) prior to circulating down the hole, and will thereby maintain the dual gradient effect and the hydrostatic pressure needed to control the well. Surface-controlled valve 42 will close off the well while the mixed-density mud 4 is displaced into the annulus between drill pipe landing string 41 and riser 2.

Figure 5:
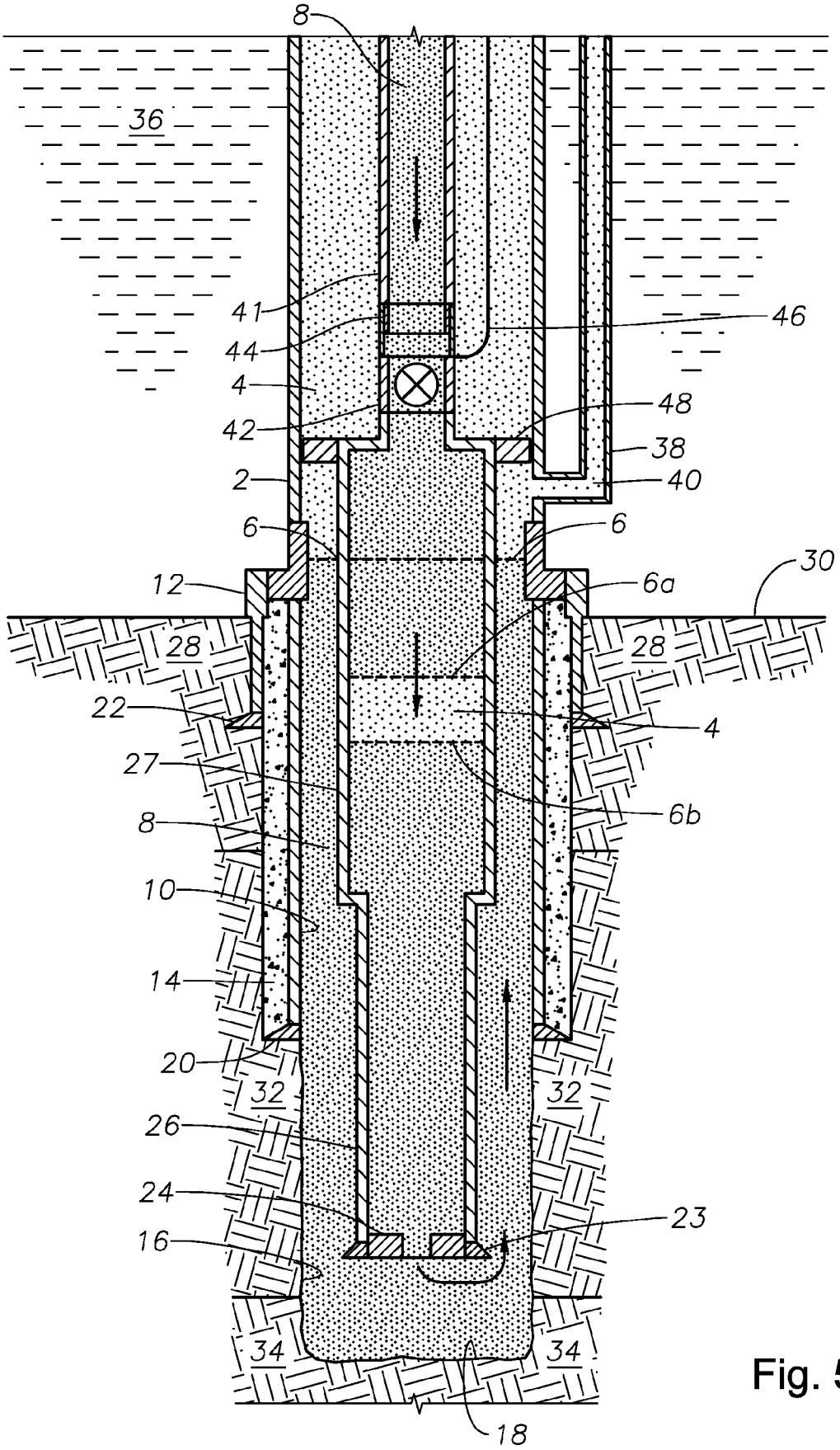
Figure 6:
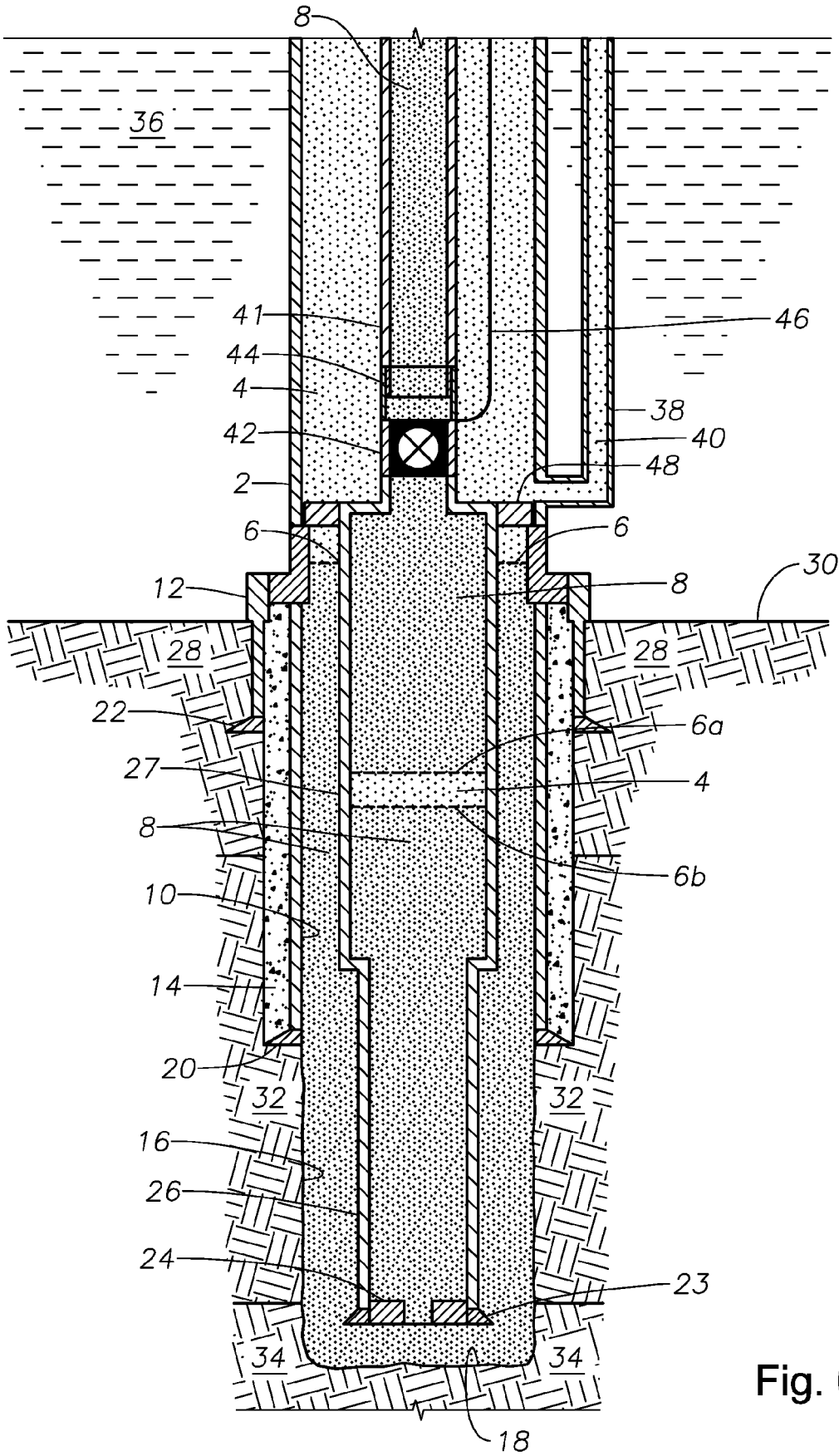

Following FIG. 4 to FIG. 5, after the relatively high-density mud 8 has been displaced into drill pipe landing string 41, the ports of surface-controlled circulating sub 44 are closed and surface-controlled valve 42 is opened and circulating (or washing) the casing down commences as drill pipe landing string 41 is lowered into the well. A small volume of mixed-density mud 4 is left sandwiched between regions of relatively high-density mud 8 between interfaces 6*a* and 6*b*.

Conventionally, after each stand of DPLS 41 is lowered as the casing continues to be run, it is necessary to stop pumping, let the well stop flowing and add an additional stand of drill pipe to be lowered into the well. As the well does not contain fluids of the same density inside and outside the pipe the well will "u-tube" strongly when the pumps are stopped. A casing flow-stop valve could serve this purpose, but such valves are not known to exist. In contrast to conventional methods, methods and systems of the present disclosure will use the surface-controlled valve and surface-controlled ported circulation sub to prevent the strong u-tube effect. This is accomplished (refer to FIG. 6) by stopping the mud pumps (not illustrated) and closing the surface-controlled valve 42. The surface-controlled ported circulating sub 44 will also be left closed. The drill pipe landing string 41 is therefore closed off and u-tubing cannot occur. The next stand of drill string is added and surface-controlled valve 42 re-opened. The process of running casing then continues.

Figure 7:
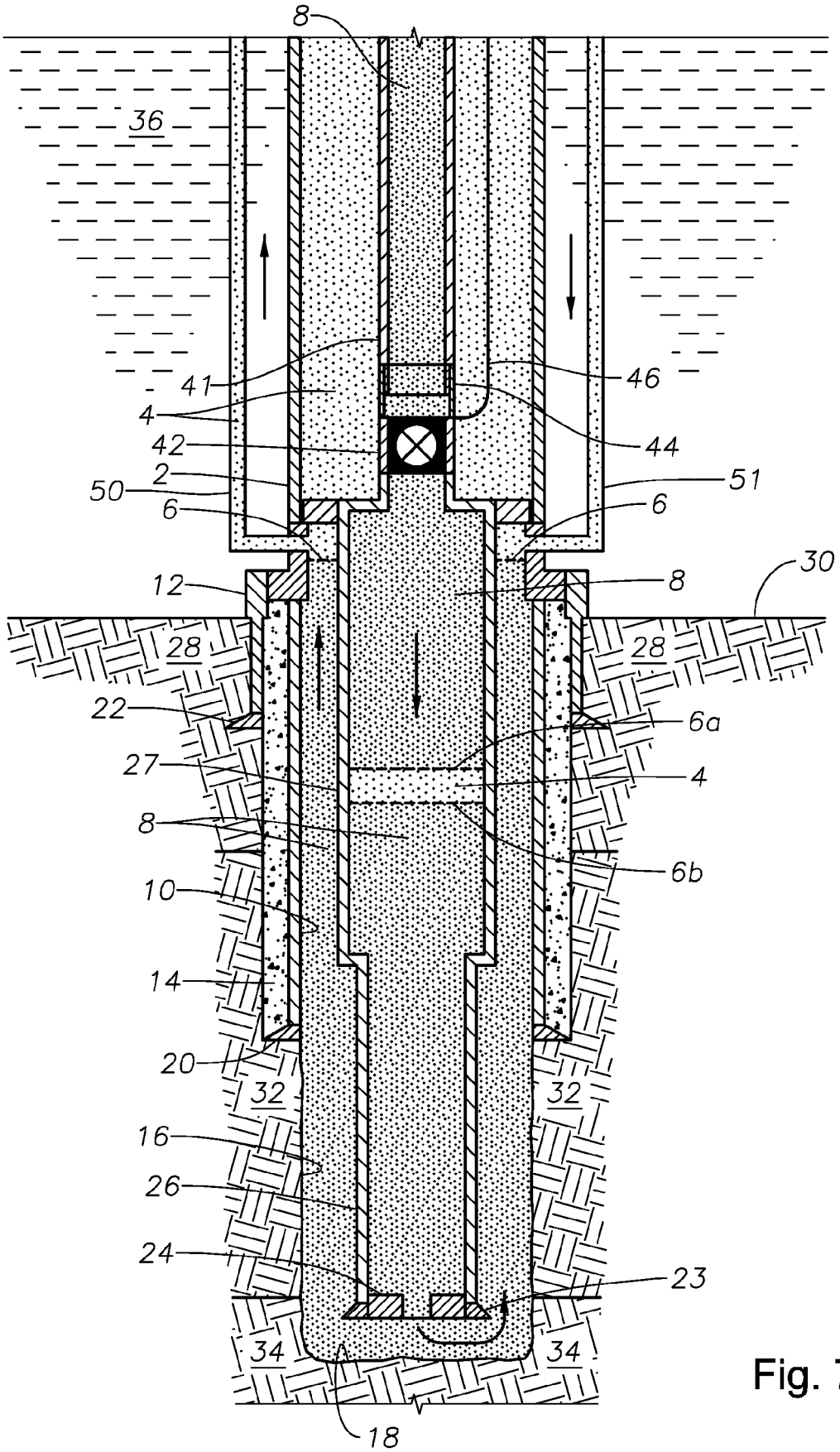
FIG. 7 illustrates schematically, in cross-section, a system and method of the disclosure for well control in accordance with the present disclosure.

FIG. 7 illustrates a contingency for well control, and this is considered a method of the disclosure as well. Unlike current conventional operations, if it is necessary to close in the well due to a well control issue, in well control methods of the present disclosure the surface-controlled valve 42 may be closed and the drill pipe landing string 41 tested prior to well control operations, all while maintaining the dual gradient mud system. Conventional techniques require dropping a steel ball to close a ported diverter sub near the bottom of the drill pipe landing string 41, waiting for it to fall while the well continues to flow and then pressuring up with a pump to acquire drill pipe landing string integrity. Well control may use choke and kill lines as known in the art. A choke line is illustrated at 50, while a kill line is illustrated at 51.

Figure 8:
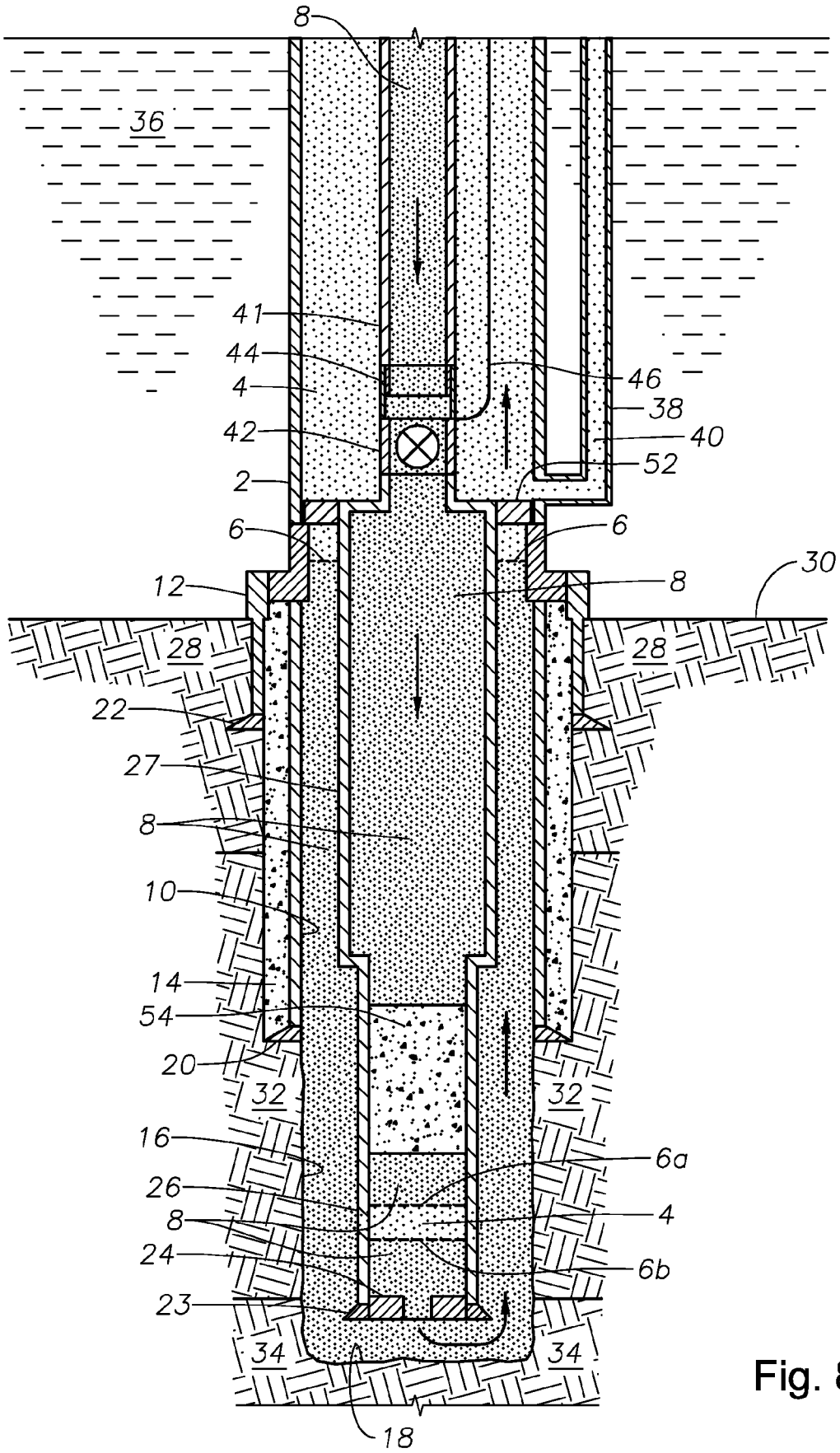

Cementing operations using methods and systems of this disclosure are similar to the washing down operations. Referring to FIG. 8, to rig up cementing equipment after the last casing 27 has landed in the subsea wellhead at 52, the surface-controlled valve 42 is closed and the cement equipment is rigged up to drill pipe landing string 41. Surface-controlled valve 42 is re-opened and ported circulation sub 44 closed if required. Cementing operations are then performed conventionally while the benefits of the dual-gradient effect are maintained. Cement (non-hardened) 54 is pumped down casings 27 and 26 and pumped into the annulus between casing 26 and wellbore 16, as depicted by the arrows in FIG. 8. The dual gradient effect is maintained as before by blending a portion of the relatively high-density mud returning from the well below the mudline with a portion of the relatively low-density mud pumped via the boost line to maintain the mixed fluid density in the marine riser.

Figure 9:
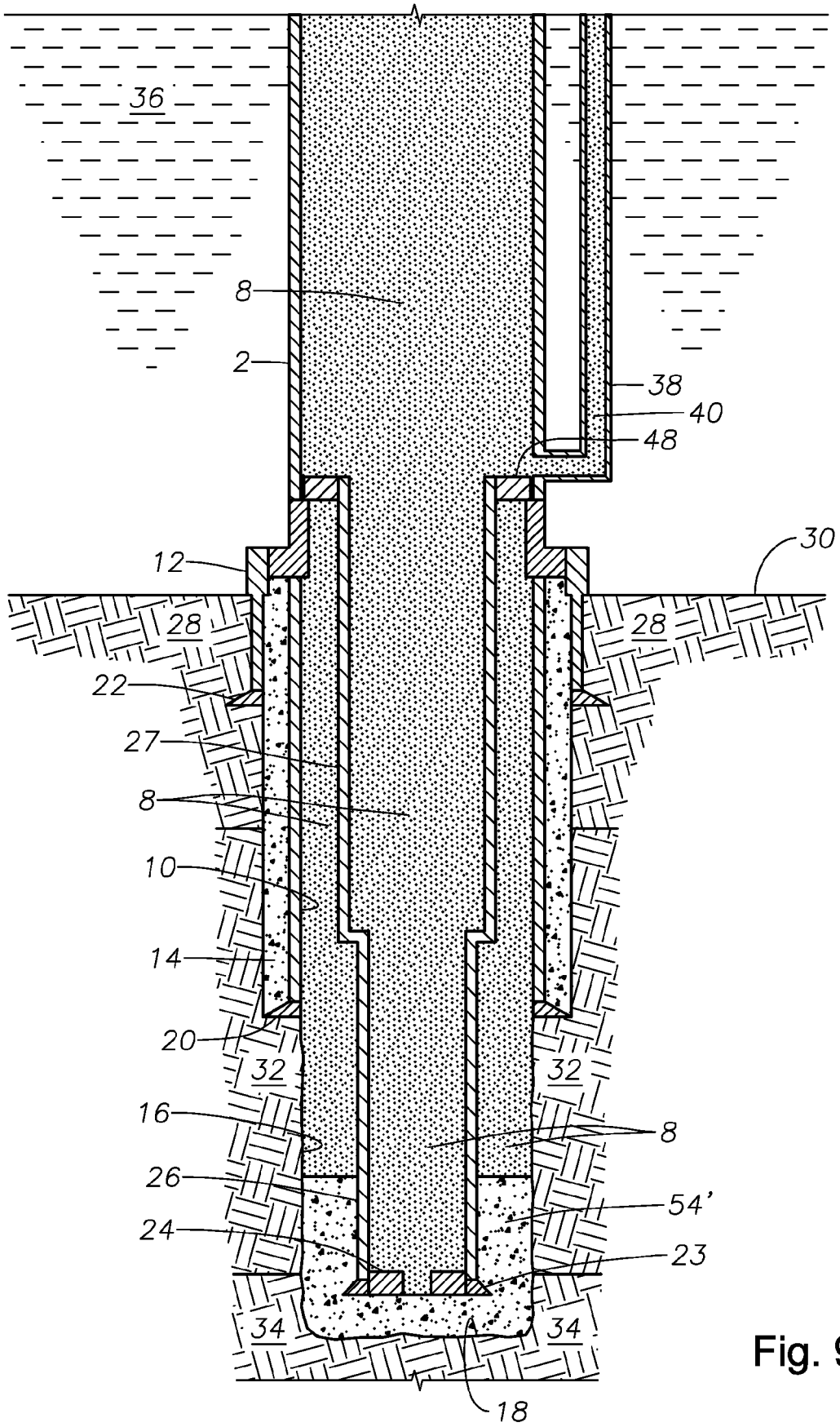

FIG. 9 illustrates that after cementing operations the mixed-density mud may be circulated from the well using surface-controlled valve 42 and ported circulating sub 44, or left in place and the densities of the relatively low-density mud, the relatively high-density mud, and/or the mixed density mud adjusted as needed for the next hole section.

Figure 10:
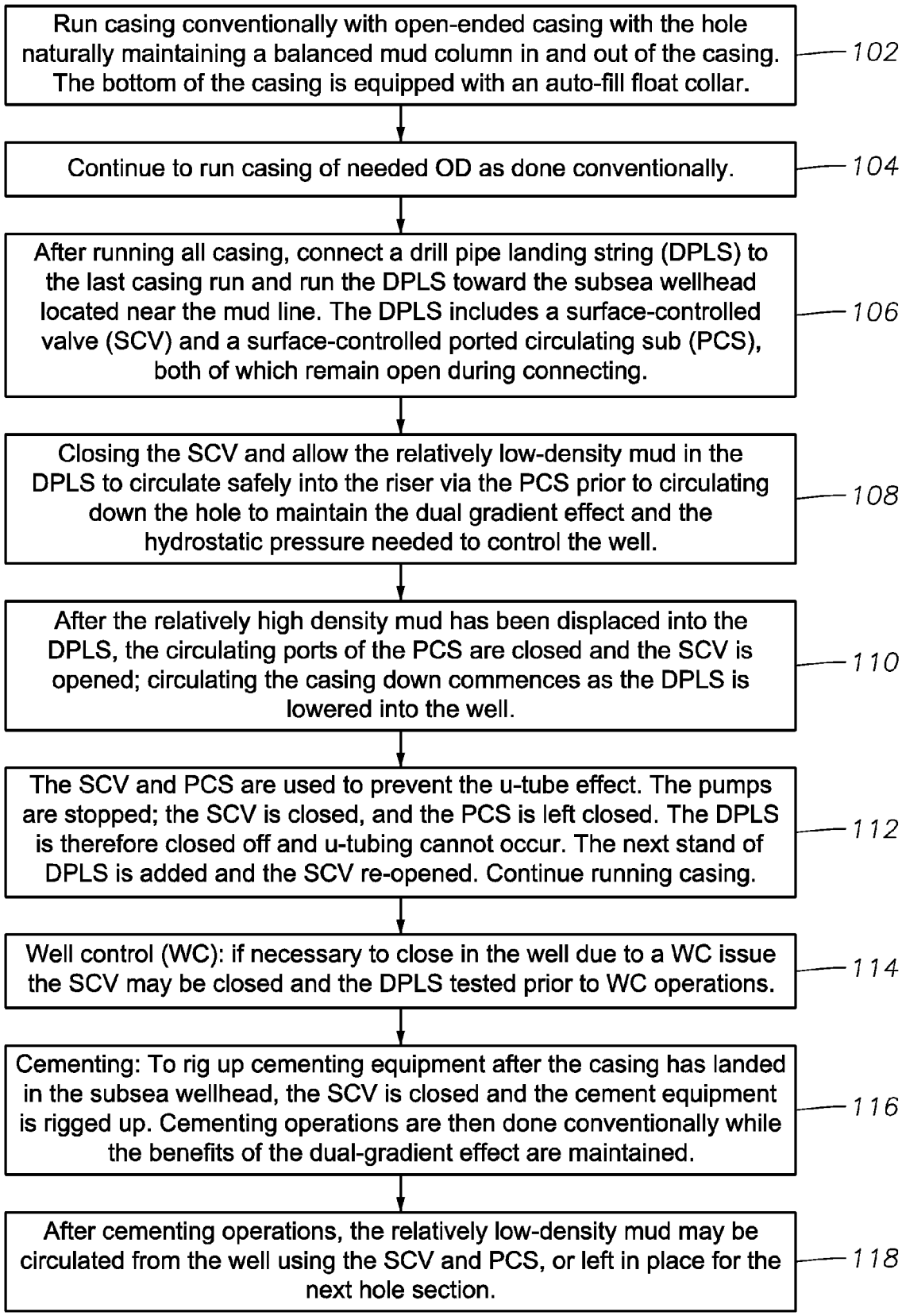
FIG. 10 illustrates a logic diagram of one method within the disclosure.

FIG. 10 illustrates a logic diagram of a method within the disclosure. In box 102, start running casing conventionally with open-ended casing with the hole naturally maintaining a balanced mud column in and out of the pipe. The bottom of the casing is equipped with an "auto-fill" type casing float collar which is essentially open-ended until converted to a one-way valve for cementing. In box 104, continue to run casing of needed OD as done in conventional operations. In box 106, after running all casing, the casing continues to be run on into the well with a drill pipe landing string (DPLS) to the subsea wellhead located near the mud line. The DPLS incorporates a surface-controlled valve (SCV) and a surface-controlled ported circulating sub (PCS). The SCV and PCS control the movement of different fluid densities into the well. In box 108, near the bottom of the well the casing may need to be circulated or washed down. Without this technique, circulation would send the undesired mixed-density mud present in the top of the well in the DPLS down the casing and threaten the hydrostatic balance of the well. Using a system and method of this disclosure, the mixed-density mud in the DPLS is allowed to be circulated safely into the riser via the PCS prior to circulating down the hole and will thereby maintain the dual-gradient effect and the hydrostatic pressure needed to control the well. The SCV is used to close off the well while the fluid is displaced. In box 110, after the relatively high-density mud has been displaced into the DPLS, the circulating ports of the PCS are closed and the SCV is opened, and circulating the casing down (sometimes referred to in the art as "washing down") commences as the DPLS is lowered into the well. In box 112, the SCV and PCS are used to prevent the strong u-tube effect. The pumps are stopped and the SCV is closed. The PCS is left closed. The DPLS is therefore closed off and u-tubing cannot occur. The next stand of drill string is added and the SCV re-opened. The process of running casing continues. In box 114, well control (WC) may be performed by closing the SCV and testing the DPLS prior to WC operations. Conventional techniques require dropping a steel ball to close a ported diverter sub near the bottom of the landing string, waiting for it to fall while the well continues to flow and then pressuring up with a pump to acquire drillpipe landing string integrity. In box 116, cementing is similar to the washing down operation. To rig up cementing equipment after the casing has landed in the subsea wellhead, the SCV is closed and the cement equipment is rigged up. The SCV 42 is re-opened, and the PCS 44 remains closed. Cementing operations are then done conventionally while the benefits of the dual-gradient effect are maintained. In box 118, after cementing operations the relatively low-density mud may be circulated from the well using the SCV and PCS, or left in place and the density of the relatively high-density mud 8 adjusted using the relatively low-density mud for the next hole section. If washing down is not required, the casing may be run to bottom without having to circulate while running. In this event, once the casing is run to bottom and landed, the SCV and PCS would be used as described above in the first step of the wash-down process. The mixed-density mud in the DPLS would be displaced into the riser by closing the SCV, opening the PCS and displacing the mixed-density mud with a portion of the relatively high-density mud. The PCS is closed, the SCV opened and the well can then be circulated prior to cementing while maintaining the mixed-density mud weight in the riser by blending the returning relatively high-density mud from below the mudline with a portion of the relatively low-density mud via the boost line as required.

Systems and methods of this disclosure may benefit from and interact with conventional sub-systems known in the art. For example, a typical subsea intervention set-up may include a bail winch, bails, elevators, a surface flow tree, and a coiled tubing or wireline BOP, all above a drill floor of a Mobile Offshore Drilling Unit (MODU—not shown). Other existing components may include a compensator, a flexjoint (also referred to as a flexible joint), a subsea tree, and a tree horizontal system connecting to wellhead 12. Other components may include an emergency disconnect package (EDP), various umbilicals, an ESD (emergency shut down) controller, and an EQD (emergency quick disconnect) controller. A conventional BOP stack may be used. A conventional BOP stack may connect to a marine riser, a riser adapter or mandrel having kill and choke connections, and a flexjoint. The BOP stack may comprise a series of rams and a wellhead connector. Conventional BOP stacks are typically 43 feet (13 meters) in height, although it can be more or less depending on the well.

An alternative to the conventional BOP stack would be a system such as described in assignee's co-pending U.S. Ser. No. 12/511,471, filed Jul. 29, 2009 and U.S. Ser. No. 61/085,043, filed Jul. 31, 2008, which are incorporated herein by reference. These systems may include: a lower riser package (LRP) comprising a tree connector and a lower spool body, the tree connector comprising an upper flange having a gasket profile for at least one annulus and a seal stab assembly on its lower end for connecting to a subsea tree, means for sealing the lower spool body upon command (in certain embodiments this may be a sealing ram and a gate valve), the lower spool body comprising a lower flange having a profile for matingly connecting with the upper flange of the of the tree connector and an upper flange having same profile; an emergency disconnect package (EDP) comprising an upper spool body having a quick disconnect connector on its lower end, means for sealing the upper spool body upon command (in certain embodiments this may be an inverted sealing ram and a retainer), and at least one annulus isolation valve, the upper spool body having an internal tie-back profile; and c) an internal tie-back tool (ITBT) connected to the upper spool body via the internal tie-back profile.

Systems within the present disclosure may take advantage of existing components of an existing BOP stack, such as flexible joints, riser adapter mandrel and flexible hoses including the BOP's hydraulic pumping unit (HPU). Also, the subsea tree's existing Installation WorkOver Control System (IWOCS) umbilical and HPU may be used in conjunction with a subsea control system comprising umbilical termination assembly (UTA), ROV panel, accumulators and solenoid valves, acoustic backup subsystems, subsea emergency disconnect assembly (SEDA), hydraulic/electric flying leads, and the like, or one or more of these components supplied with the system.

In accordance with the present disclosure, a primary interest lies in using one or more of the methods and systems described herein to run casing in wells drilled using dual gradient mud systems, perform well control operations when needed while maintaining the dual gradient effect, and cementing operations while maintaining the dual gradient effect. The skilled operator or designer will determine which system and method is best suited for a particular well and formation to achieve the highest efficiency, safest, and environmentally sound casing, well control, and/or cementing operation without undue experimentation.

A non-exhaustive list of casing pipes that may be used in practicing the methods and systems described herein include surface and intermediate casings described in Table 1.

TABLE 1*

| Surface casings | Intermediate casings |
|---|---|
| Threaded & Coupled | Threaded & Coupled |
| Wedge ™ 563 | Blue ™ |
| ER ™ | Wedge ™ 563 |
| Integral | 3SB ™ |
| Wedge ™ 523 | MS ™ |
| Wedge ™ 521 | HW ™ |
| Wedge ™ 513 | Integral |
| Wedge ™ 511 | Blue ™ Near |
| Flush | Wedge ™ 523 |
| | Wedge ™ 521 |
| | SLX ™ |
| | MAC-II ™ |

*All trademarks are owned by TenarisHydril, Inc.

Many of the detailed mechanical and compositional features of these casings are proprietary to the manufacturers and suppliers of such casings. It is believed that all of the casings mentioned in Table 1 are steel, and are available in a range of nominal sizes. For casings known under the trade designation Wedge™, the first digit refers to the series of casing (5=threaded), the second digit refers to configuration and pipe ends (for example, 0 means integral connection on external upset pipe; 1 means integral connection on non-upset pipe with pipe body OD box; 2 means integral connection on non-upset pipe with swaged OD box; 3 means integral connection on internal/external upset pipe; 5 means integral connection on non-upset pin end and upset box end pipe; and 6 means coupled connection on non-upset pipe), and the third digit refers to the sealing mechanism (for example, 1 means wedge thread and lubricant seal, and 3 means metal seal plus wedge thread and lubricant seal). The casing known under the trade designation Wedge™ 563, which may be employed either as surface casing, intermediate casing, or both in the context of the systems and methods described herein, is presently available in nominal sizes (diameters) from 2⅜ inch up to 16 inches (6 cm up to 40 cm), has 100% ratings in tension and compression provided by dovetail threads, and 100% collapse rated thread seal created by full form contact of the dovetail threads, also providing a secondary internal pressure seal rated at pipe body. Characteristics of the other casings mentioned in Table 1 are available from the manufacturer, TenarisHydril, as are characteristics of casings manufactured and/or supplied by other casing manufacturers.

Suitable auto-fill collars, also called float collars in the art, for use in the systems and methods of this disclosure include, but are not limited to, those described in U.S. Pat. Nos. 6,401,824; 6,684,957; and 6,712,145, all of which are incorporated herein by reference. For example, the auto-fill collar described in the '824 patent is characterized by an inner tubular member and outer tubular member, movable upon release of shear pins to cause longitudinal movement relative to each other. The movement of the inner tubular member closes a plurality of downward jets and opens a plurality of upward jets. The apparatus also is equipped with a set of check valves, held open on run in, and activated to close upon cementing to prevent "u-tubing" of fluid back into the casing. The auto-fill collars of the '957 and '145 patents are characterized by being fabricated using plastic flapper valves and sleeve components in contrast to other float collar components which are fabricated almost entirely of relatively hard metals. The use of plastic components in the float collars provides a substantial reduction in time and resources expended during drilling out of the float collar once cementing operations are completed. Additionally, the float collars described in the '975 and '145 patents are fabricated from a pre-determined combination of plastic components and metal components thereby ensuring that the float collars can still endure substantial hydrostatic stresses encountered during casing running in and cementing operations.

Surface-controlled valves (SCVs) useful in systems and methods of this disclosure are known, and are similar in operation to drill stem test (DST) valves, such as those described in U.S. Pat. Nos. 4,399,870 and 4,658,904, both of which are incorporated herein by reference. The '870 patent describes a valve used in a drill stem test tool having a ball movable between an open position to allow flow through the drill string for testing and a closed position to block flow. Operating means move the ball between the open and closed positions in response to pressures in the well annulus. A nitrogen filled pressure chamber and pressure balancing piston compensate for variations in annular pressure as the tool is being lowered into position in the well. Actuating means including a weight operated sleeve are operated from the surface to overcome the compensating effect of the pressure balancing piston to allow the ball to be rotated to the open position. The ball is spring biased toward the closed position by a coil spring located inside the pressure chamber. Relieving pressure in the annulus causes the spring to close the ball. The '904 patent describes a similar ball valve which may be used as a fail-close device under the influence of a spring and nitrogen pressure. Additional assistance in closing the valve may be provided by hydraulic pressure applied to a surface control line.

Ported circulation subs are known in the art, and useful ported circulation subs are disclosed, for example, but not by way of limitation, in U.S. Pat. Nos. 5,029,642 and 6,003,834, both of which are incorporated herein by reference for their description of ported circulation subs and their operation. The ported circulation subs described in the '834 patent include a tubular body member having a longitudinal bore eccentrically extending therethrough, and having a well known means for interconnection with the tubing string. At least one fluid communication port extends through a sidewall of the tubular body member, and a ported sleeve is sealably placed thereacross for selectively permitting and preventing fluid flow through the fluid communication port. The sleeve is biased, such as by a spring, in a normally closed position to prevent accidental release of drilling fluids in the event that the valve operating mechanism fails, but is normally cycled from open to closed by the application of hydraulic fluid on either end of an operating piston. A fluid control device such as a solenoid valve directs hydraulic fluid in response to electrical signals sent from a controller located on a floating or submerged platform to the appropriate surface of the operating piston and/or to an exhaust port.

From the foregoing detailed description of specific embodiments, it should be apparent that patentable methods and systems have been described. Although specific embodiments of the disclosure have been described herein in some detail, this has been done solely for the purposes of describing various features and aspects of the methods and systems, and is not intended to be limiting with respect to the scope of the methods and systems. It is contemplated that various substitutions, alterations, and/or modifications, including but not limited to those implementation variations which may have been suggested herein, may be made to the described embodiments without departing from the scope of the appended claims.

What is claimed is:

1. A system comprising, in combination:

a riser conduit for containing a mixed-density drilling mud above the mud line, the mixed-density mud formed by mixing a portion of a relatively high-density mud with a portion of a relatively low-density mud, the riser conduit fluidly connecting a floating or semi-submersed platform to a subsea wellhead located substantially at the mud line, the wellhead fluidly connecting the riser conduit and a subsea well accessing a subsea formation of interest;

a plurality of casing members comprising a first casing member and a last casing member run into the well for casing the subsea well in the presence of a relatively high-density drilling mud in the well;

a drill pipe landing string comprising a surface-controlled valve at its distal end, and a ported circulation sub located just above the surface-controlled valve, wherein the distal end of the first casing member comprises an auto-fill casing float collar, wherein the distal end of the drill pipe landing string fluidly connects to a proximal end of the last casing member run in the well, and wherein the surface-controlled valve and the ported circulation sub are positioned to substantially maintain the dual gradient mud system in the riser conduit and well during running in of casing into the well.

2. The system of claim 1 comprising a control system providing a control connection between the surface-controlled valve and a controller on the floating or semi-submersed platform.

3. The system of claim 1 comprising one or more density control lines fluidly connecting the riser internal space just above the mud line with a source of a relatively low-density mud, wherein the relatively low-density mud has a density less than density of the relatively high-density drilling mud.

4. The system of claim 1 comprising one or more pressure indicators coupled to the riser, substantially near the mud line.

5. The system of claim 1 comprising cement between a casing member and the well bore.

6. The system of claim 1 wherein the ported circulation sub comprises a plurality of ports that may be opened or closed using a control signal from the floating or semi-submersed platform.

7. The system of claim 1 wherein the auto-fill collar is selected from the group consisting of float collars manufactured using plastic flapper valves and sleeve components, and float collars manufactured using metal flapper valves and sleeve components.

8. The system of claim 1 wherein the surface-controlled valve is a drill stem test valve comprising a ball movable between an open position to allow flow through the drill pipe landing string and a closed position to block flow through the drill pipe landing string.

9. A method for running casing in wells drilled with dual-gradient mud systems, the mud system comprising a relatively low-density mud, a mixed-density mud and a relatively high-density mud, the method comprising:

running two or more casing members including a first casing member and a last casing member through a subsea wellhead connected to a marine riser, the first casing member equipped with an auto-fill float collar on its distal end, the marine riser filled with a mixed-density mud, the mixed-density mud formed by mixing a portion of the relatively high-density mud with a portion of the relatively low-density mud;

connecting a drill pipe landing string (DPLS) to the last casing member run and running the DPLS toward the wellhead located near the mud line, the DPLS including a surface-controlled valve (SCV) and a surface-controlled ported circulating sub (PCS);

closing the SCV and circulating the mixed-density mud in the DPLS into the riser by pumping the relatively high-density mud via the PCS prior to circulating down the hole;

closing the circulating ports of the PCS and opening the SCV, and commencing circulating the casing down by pumping the relatively high-density mud as the DPLS is lowered into the well;

stopping pumping, closing the SCV, leaving the PCS closed, thereby closing off the DPLS so u-tubing cannot occur;

and connecting another stand of DPLS, opening the SCV, and continue running casing and DPLS until landing the casing on the subsea wellhead.

10. The method of claim 9 comprising, if necessary, closing the SCV and testing the DPLS prior to well control operations while maintaining the dual-gradient effect.

11. The method of claim 9 comprising closing the SCV, rigging up cementing equipment to the DPLS, re-opening the SCV, with the PCS remaining closed, and commencing cementing operations while maintaining the dual-gradient effect.

12. The method of claim 11 comprising, after cementing operations, circulating the relatively low-density mud from the well using the SCV and PCS.

13. The method of claim 11 comprising, after cementing operations, leaving the relatively low-density mud in place and adjusting the density of the relatively high-density mud using the relatively low-density mud for casing a subsequent hole section.

14. The method of claim 9 wherein the opening and closing of the SCV is by controlling a ball movable between an open position to allow flow through the DPLS and a closed position to block flow through the DPLS.

15. The method of claim 9 wherein the dual gradient effect is at least partially maintained by the addition of beads to the relatively high-density mud, the beads having density less than the density of the relatively high-density mud.

16. A method of cementing casing run in wells drilled with dual-gradient mud systems, the method comprising:

running two or more casing members including a first casing member and a last casing member through a subsea wellhead connected to a marine riser, the first casing member equipped with an auto-fill float collar on its distal end, the marine riser filled with a mixed-density mud, the mixed-density mud formed by mixing a portion of the relatively high-density mud with a portion of the relatively low-density mud;

connecting a drill pipe landing string (DPLS) to the last casing member run and running the DPLS toward the wellhead located near the mud line, the DPLS including a surface-controlled valve (SCV) and a surface-controlled ported circulating sub (PCS); if required prior to cementing, closing the SCV and circulating the mixed-density mud in the DPLS into the riser by pumping the relatively high-density mud via the PCS prior to cementing;

closing the circulating ports of the PCS and opening the SCV, and commencing circulating the casing down by pumping the relatively high-density mud prior to and during cementing;

stopping pumping, closing the SCV, and leaving the PCS closed, thereby closing the DPLS so u-tubing cannot occur;

connecting another stand of DPLS, and continue running casing until landing the casing on the subsea wellhead; and closing the SCV, rigging up cementing equipment to the DPLS, re-opening the SCV, with the PCS remaining closed, and commencing cementing operations while maintaining the dual-gradient effect.

17. The method of claim 16 comprising, if necessary, closing the SCV and testing the DPLS prior to well control operations while maintaining the dual-gradient effect.

18. The method of claim 16 comprising, after cementing operations, circulating the relatively low-density mud from the well using the SCV and PCS.

19. The method of claim 16 comprising, after cementing operations, leaving the relatively low-density mud in place and adjusting the density of the relatively high-density mud using the relatively low-density mud for casing a subsequent hole section.

20. The method of claim 16 wherein the opening and closing of the SCV is by controlling a ball movable between an open position to allow flow through the DPLS and a closed position to block flow through the DPLS.

21. The method of claim 16 wherein the dual gradient effect is at least partially maintained by the addition of beads to the relatively high-density mud, the beads having density less than the density of the relatively high-density mud.

* * * * *